US011226095B2

(12) United States Patent
Phillips et al.

(10) Patent No.: US 11,226,095 B2
(45) Date of Patent: Jan. 18, 2022

(54) VELOCITY DAMPER FOR A RECOVERY BOILER

(71) Applicant: Andritz Inc., Alpharetta, GA (US)

(72) Inventors: John Phillips, Alpharetta, GA (US); David Watson, Alpharetta, GA (US)

(73) Assignee: ANDRITZ INC., Alpharetta, GA (US)

( * ) Notice: Subject to any disclaimer, the term of this patent is extended or adjusted under 35 U.S.C. 154(b) by 149 days.

(21) Appl. No.: 16/747,174

(22) Filed: Jan. 20, 2020

(65) Prior Publication Data

US 2020/0240635 A1 Jul. 30, 2020

Related U.S. Application Data

(60) Provisional application No. 62/797,522, filed on Jan. 28, 2019.

(51) Int. Cl.

| | |
|---|---|
| ***F23L 13/02*** | (2006.01) |
| ***F23L 9/00*** | (2006.01) |
| ***F23L 13/00*** | (2006.01) |
| ***F24F 140/40*** | (2018.01) |
| ***F23J 3/00*** | (2006.01) |

(52) U.S. Cl.

CPC ..... *F23L 13/02* (2013.01); *F23L 9/00* (2013.01); *F23L 13/00* (2013.01); *F23C 2201/101* (2013.01); *F23J 3/00* (2013.01); *F23N 2235/06* (2020.01); *F24F 2140/40* (2018.01)

(58) Field of Classification Search

CPC ..... F23L 13/00

See application file for complete search history.

(56) References Cited

U.S. PATENT DOCUMENTS

| | | | | |
|---|---|---|---|---|
| 2,126,994 | A | 8/1938 | Irsch et al. | |
| 2,320,194 | A * | 5/1943 | Olsen | F23N 3/02 137/504 |
| 3,727,984 | A * | 4/1973 | Beck | B65G 51/03 414/676 |
| 3,742,916 | A | 7/1973 | Wessberg et al. | |
| 4,099,471 | A | 7/1978 | Sander et al. | |
| 4,724,863 | A | 2/1988 | Connor | |
| 4,838,182 | A | 6/1989 | Goodspeed | |

(Continued)

OTHER PUBLICATIONS

International Application No. PCT/US2020/014265, International Preliminary Report on Patentability dated Aug. 12, 2021, 8 pages.

(Continued)

*Primary Examiner* — David J Laux

(74) *Attorney, Agent, or Firm* — Kilpatrick Townsend & Stockton LLP

(57) ABSTRACT

A method is provided for controlling airflow into a furnace that employs a velocity type damper. In one embodiment, the method for controlling airflow may include engaging a velocity type damper to an air port opening of a furnace. The velocity type damper includes at least one air controlling surface that is positioned proximate to a wall of the furnace at the air port opening so that air velocity exiting the at least one air controlling surface is substantially equal to the air velocity entering the air port opening to the furnace. The method may further include adjusting a cross sectional area through the velocity type damper to control air velocity into the furnace through the air port opening.

8 Claims, 5 Drawing Sheets

(56) References Cited

U.S. PATENT DOCUMENTS

| | | | | |
|---|---|---|---|---|
| 4,846,080 | A | | 11/1989 | Ross et al. |
| 4,940,004 | A | | 7/1990 | Jansen |
| 5,001,992 | A | | 3/1991 | Higgins et al. |
| 5,044,327 | A | | 9/1991 | Hunt |
| 5,167,192 | A | | 12/1992 | Pingel et al. |
| 5,307,745 | A | | 5/1994 | Higgins et al. |
| 5,824,275 | A | | 10/1998 | Bitzer et al. |
| 5,897,427 | A | * | 4/1999 | Tomioka ..... B24C 7/0046 451/101 |
| 6,055,943 | A | | 5/2000 | Cochrane et al. |
| 6,257,156 | B1 | | 7/2001 | Kaulamo |
| 6,497,230 | B1 | | 12/2002 | Higgins et al. |
| 7,392,751 | B2 | | 7/2008 | Bergmyren |

OTHER PUBLICATIONS

Copenhaver, Blaine R.; International Search Report, Patent Cooperation Treaty, dated Mar. 14, 2020, pp. 1-14.

* cited by examiner

VELOCITY DAMPER FOR A RECOVERY BOILER

CROSS-RELATED APPLICATION

This application claims the benefit under 35 U.S.C. § 119(e) of the earlier filing date of U.S. Provisional Patent Application No. 62/797,522 filed on Jan. 28, 2019, the entire contents of which are incorporated herein by reference.

TECHNICAL FIELD

The present disclosure generally relates to furnace and furnace components, and more particularly to an apparatus for regulating air flow through a port introducing air to a boiler.

BACKGROUND

The chemical recovery boiler is a part of the pulp production process. Specifically, the chemical recovery boiler helps recover and regenerate cooking liquors. The furnace of a chemical recovery boiler for burning black liquor has a front wall, a rear wall, and sidewalls. Black liquor spraying devices are disposed on said walls on one or several levels. A plurality of air ports are arranged on several horizontal levels on said walls for introducing air into the furnace from an air supply. Flue gas generated in black liquor combustion is led into contact with various heat transfer devices, superheaters, the boiler bank and water preheaters (economizers) of the boiler, whereby the heat present in the gas is recovered in water, steam or mixture thereof flowing in the heat transfer devices.

Air is introduced into the boiler usually at three different levels: primary air into the bottom part of the furnace, secondary air above the primary air level, but below the liquor nozzles, and tertiary air above the liquor nozzles for ensuring complete combustion. Air is usually fed in via several air ports either from all four walls of the boiler or from two opposites walls only. More than three air levels for introducing air into the furnace may be arranged in the boiler.

SUMMARY

In one aspect, a velocity type damper is provided for use for controlling airflow into a furnace. As will be described herein, it has been determined that in prior damper designs, the velocity of the air being introduced to the furnace diminishes at the exit of the damper, which is the result of a change in volume for the air passage from the damper to the inlet to the furnace. The damper provided by the present disclosure avoids this reduction in air velocity by reducing the change in volume between the damper exit and the inlet to the furnace. In some embodiments, the damper designs described herein can provide for increased control of the airflow and increased control of the velocity of the air being introduced to the furnace through the damper by aligning the damper blade edges, i.e., an edge of the air control surface for the damper, to the furnace wall at the inlet. As will be described herein, the damper blades, i.e., air control surfaces, may be hinged velocity plates and/or deformable diagram plates. Without being bounded by theory, it is believed that aligning the damper blade edges to the furnace wall ensures that the air flow passage between the damper and the inlet to the furnace does not include a pronounced increase in volume relative to the air flow passage through the damper.

The velocity type damper may include at least one velocity plate that is rotated about a hinged end to provide the air control surface of the damper. In one example of this embodiment, the velocity type damper includes an air port damper body for engagement to an air port opening of a furnace. The velocity type damper may include at least one velocity plate in hinged engagement to the air port damper body so that the air controlling end surface of the velocity plate is substantially aligned to a wall of the furnace at the air port opening when the velocity plate is in a fully opened position.

The velocity type damper may also have at least one deformable diaphragm to provide the air control surface of the damper. In one example of this embodiment, the velocity type damper includes an air port damper body for engagement to an air port opening of a furnace. The velocity type damper may also include at least one diaphragm damper in engagement to the air port damper body so that when deformed, the at least one diaphragm reduces the cross sectional area of the air port damper body. The at least one diaphragm is engaged to the air port damper body so that an end of the at least one diaphragm is substantially aligned to a wall of the furnace at the air port opening.

In another aspect, a method is provided for controlling airflow into a furnace that employs a velocity type damper. In one embodiment, the method for controlling airflow may include engaging a velocity type damper to an air port opening of a furnace, in which the velocity type damper includes at least one air controlling surface that is positioned proximate to a wall of the furnace at the air port opening so that air velocity exiting the at least one air controlling surface is substantially equal to the air velocity entering the air port opening to the furnace. The method may further include adjusting a cross sectional area through the velocity type damper to control air velocity into the furnace through the air port opening.

These and other features and advantages will become apparent from the following detailed description of illustrative embodiments thereof, which is to be read in connection with the accompanying drawings.

BRIEF DESCRIPTION OF THE DRAWINGS

The following description will provide details of embodiments with reference to the following figures wherein.

DETAILED DESCRIPTION

Figure 1:
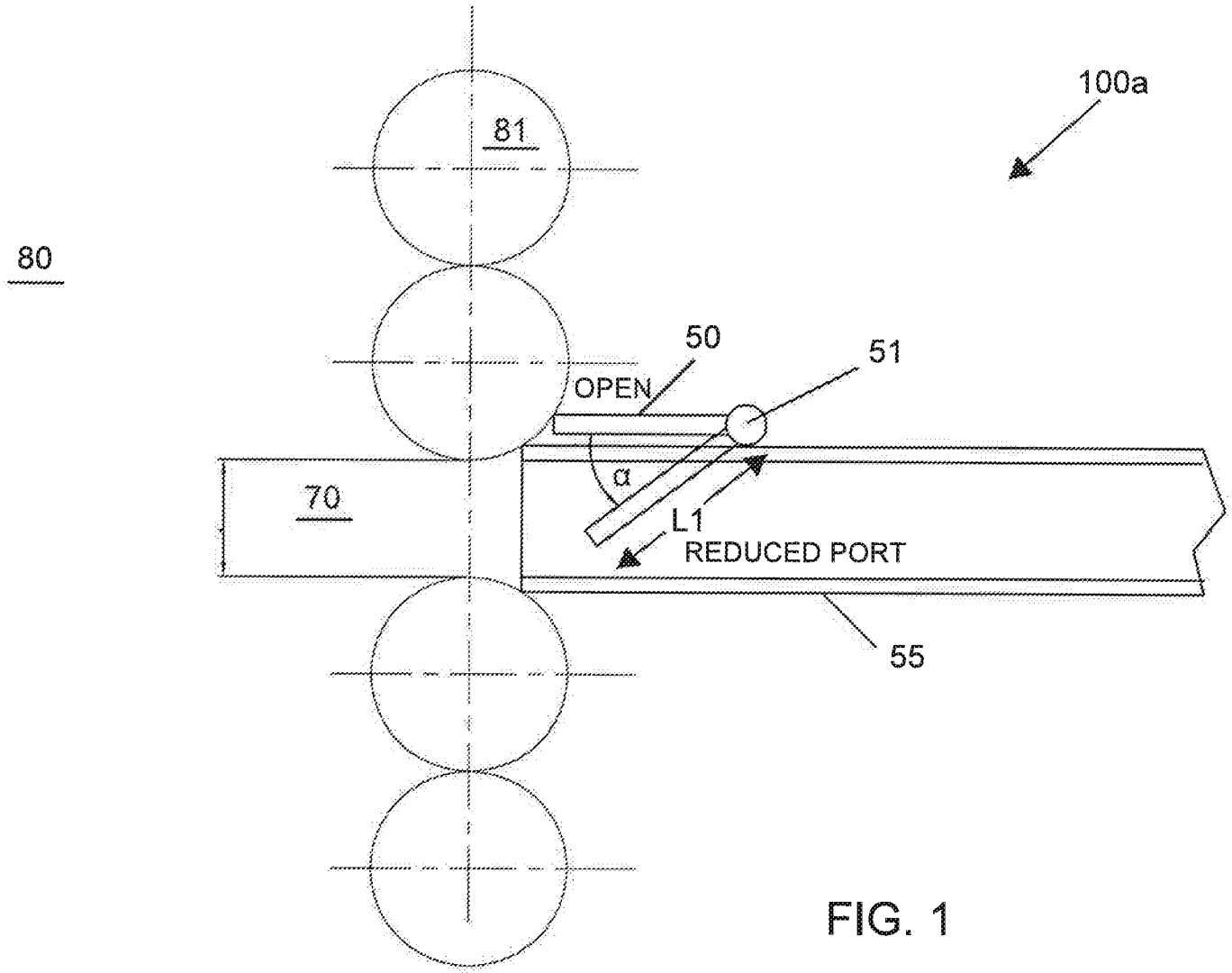
FIG. 1 is a top cross sectional view of a velocity type damper that includes a velocity plate that is rotated about a hinged end to provide the air control surface of the damper, in accordance with one embodiment of the present disclosure.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

Wood pulp for papermaking is usually manufactured according to the sulfate process wherein wood chips are treated with a cooking liquor including sodium sulfide and sodium hydroxide. The wood chips and the cooking liquor, called "white liquor," are cooked in a digester under predetermined heat and temperature conditions. After cooking, the used liquor, termed "black liquor," containing spent cooking chemicals and soluble residue from the cook, is washed out of the pulp and treated in a recovery unit where the cooking chemicals are reclaimed. Without reclamation and reuse of the cooking chemicals, the cost of the papermaking process can be prohibitive.

In the recovery process, the black liquor is first concentrated by evaporation to a low water solution, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced dries and melts the spent cooking chemicals as they fall to the floor of the firebox, where they build a mound of material called a char bed. The char bed is further heated to further liquefy the chemicals into a molten smelt that flows out of the furnace through a smelt spout to a collection tank. Concurrently, combustion heat is employed to generate steam in water walls of the boiler for use as process steam and for generating electricity.

The combustion process requires the introduction of large volumes of air into the firebox. The combustion air is distributed by means of wind boxes or ducts disposed at several levels in surrounding relation to the firebox and outside the walls of the furnace. The air is forced into the firebox from the wind boxes through a plurality of passages or air ports in the walls of the furnace, viz.: primary, secondary and tertiary air ports. The primary air ports, through which about 30 to 40 percent of the air enters the furnace, are disposed on all the walls of the firebox near the bottom of the furnace and close to the char bed. The air supplied to the primary air ports is at a comparatively low pressure in order to promote a reducing atmosphere in the burning mass of char. The secondary air ports, which are fewer in number than the primary air ports and through which about 45 percent of the air enters the furnace, are disposed around the walls of the firebox, higher than the primary air ports, and usually below the level of the entry conduits through which the black liquor is sprayed into the firebox. Air supplied through the secondary air ports is at a slightly higher pressure in order to promote burning of combustible gasses rising from the glowing mass of the char bed. While the primary air ports provide a relatively large volume of air with considerable turbulence for maintaining a fireball in the char bed, the secondary air ports are intended to provide a finer control and distribution of air above the char bed and distribute the air evenly in the black liquor spray to support the combustion thereof. Air is supplied through the tertiary air ports at a still higher pressure to promote combustion of gases rising through the firebox, the tertiary air ports being higher on the wall of the furnace than the secondary air ports.

The volume and distribution of combustion air supplied to the furnace will also vary depending on the load of the furnace and the moisture content of the liquor being reduced. The distribution and volume of air entering a furnace is conveniently adjusted by regulating means such as dampers provided in supply conduits (also referred to as "air port damper bodies") of the wind boxes. Dampers may also be provided at various locations in the wind boxes, and individual air ports may furthermore be provided with a damper, thus making possible a selective distribution of air within each wind box, or in each wind-box passage or each air port, respectively, thereby maintaining the desired air supply in all parts of the furnace.

Figure 2:
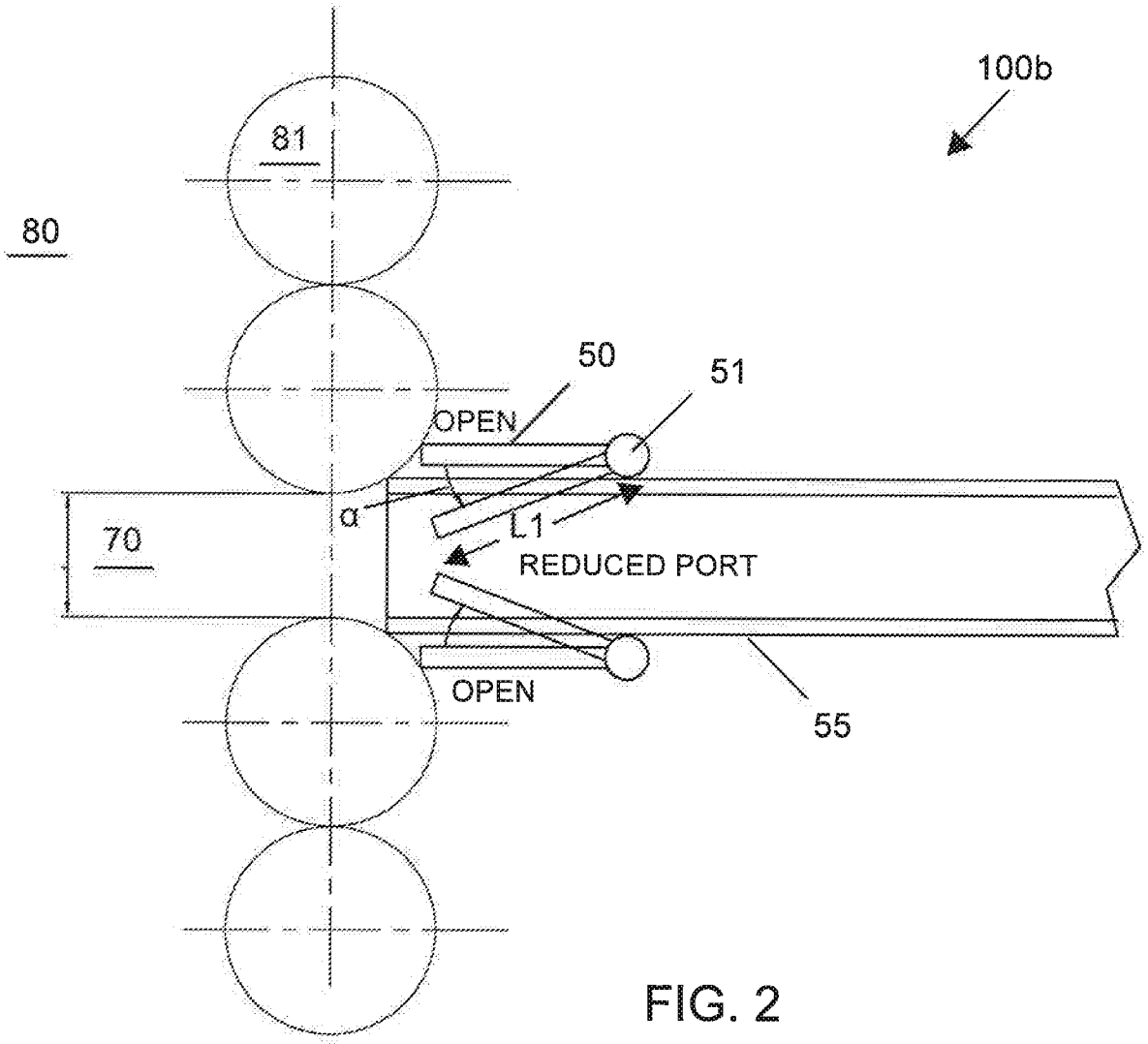
FIG. 2 is a top cross sectional view of a velocity type damper that includes two velocity plates that are positioned at opposing sides of the air port damper body that is connected to the air port to a furnace, in accordance with an embodiment of the present disclosure.
Figure 3:
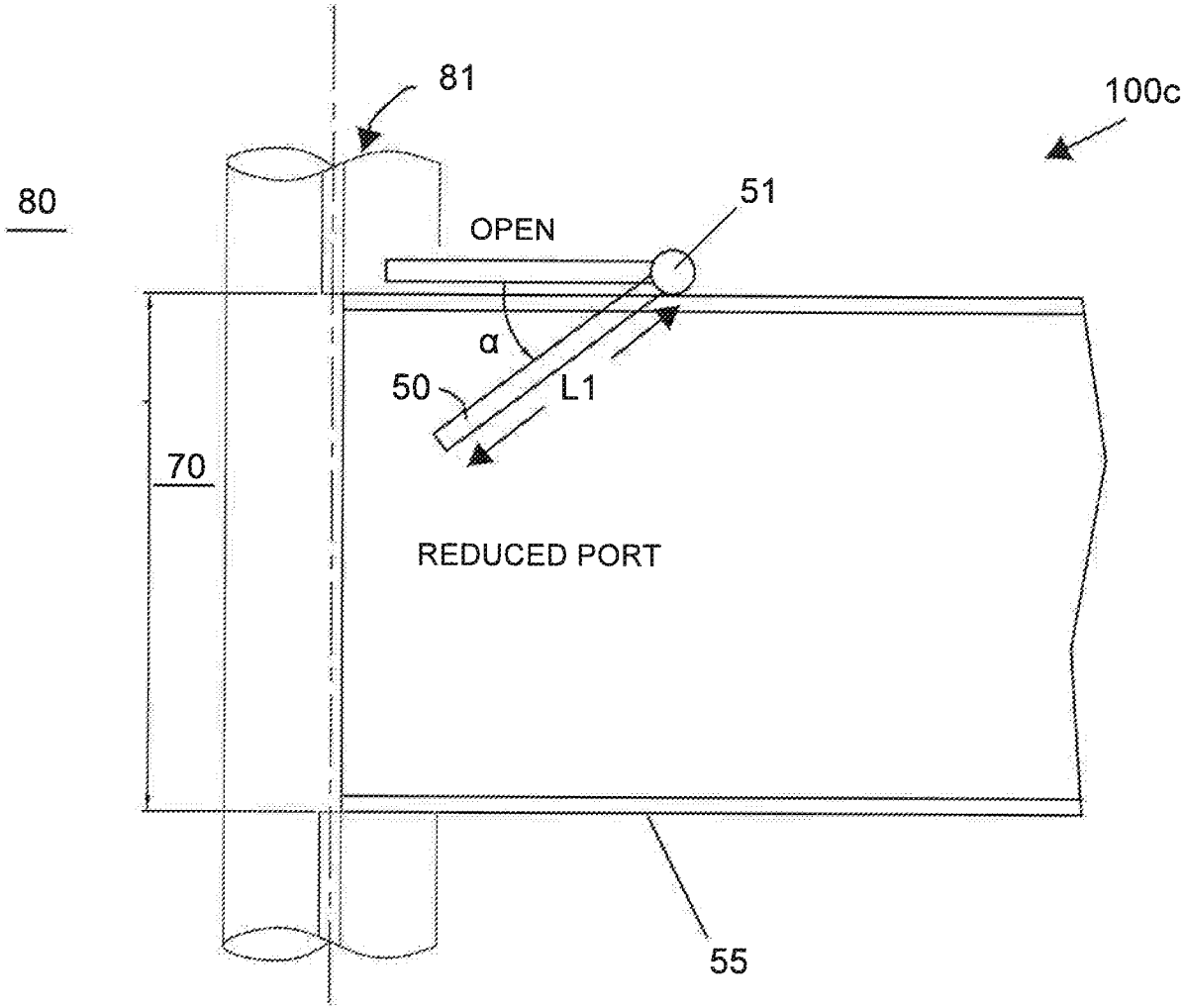
FIG. 3 is a side cross sectional view of a velocity type damper that includes a velocity plate that is rotated about a hinged end to provide the air control surface of the damper, in accordance with one embodiment of the present disclosure.
Figure 4:
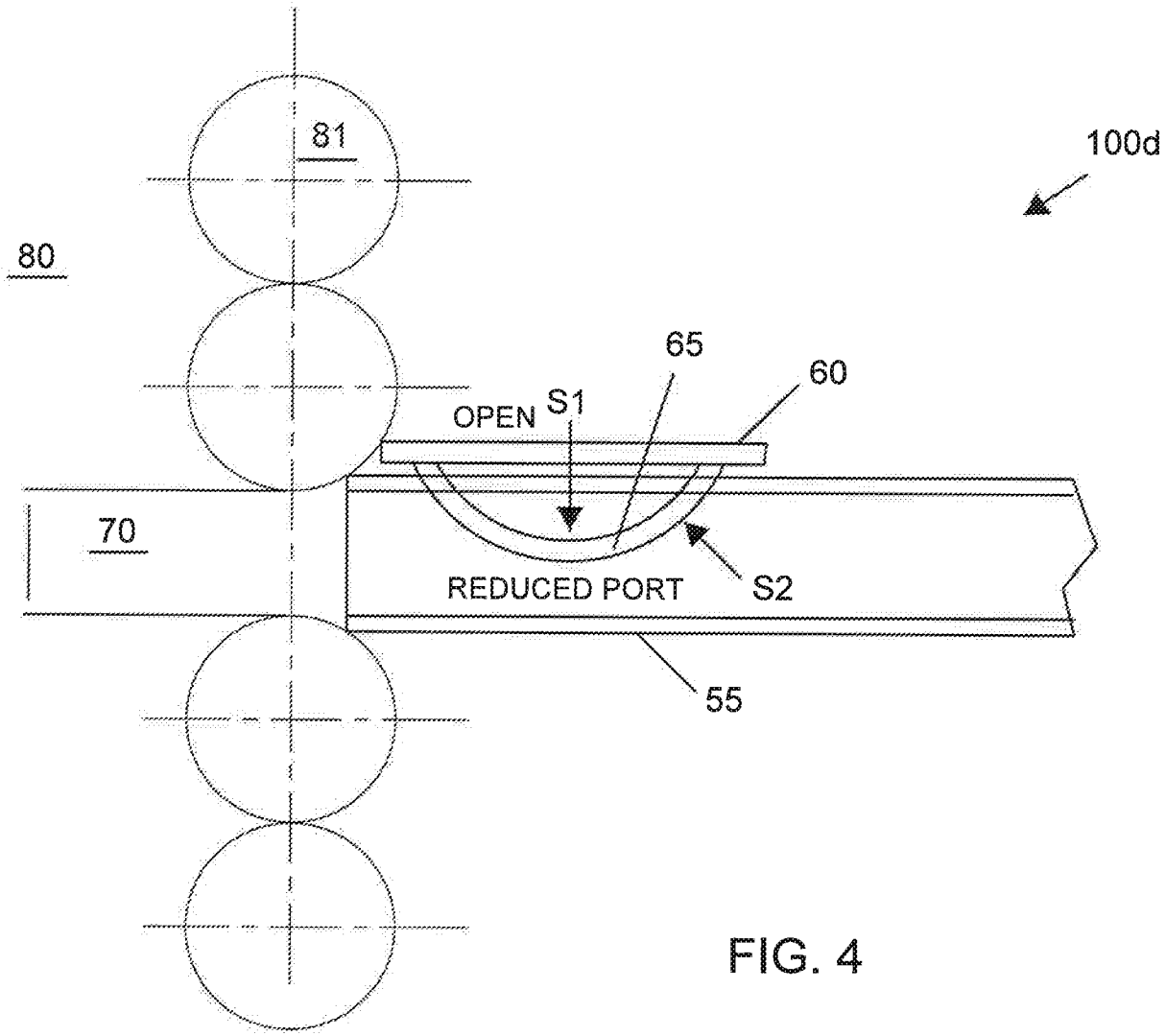
FIG. 4 is a top cross sectional view of a velocity type damper that includes a diaphragm plate that can be deformed to provide the air control surface of the damper, in accordance with one embodiment of the present disclosure.
Figure 5:
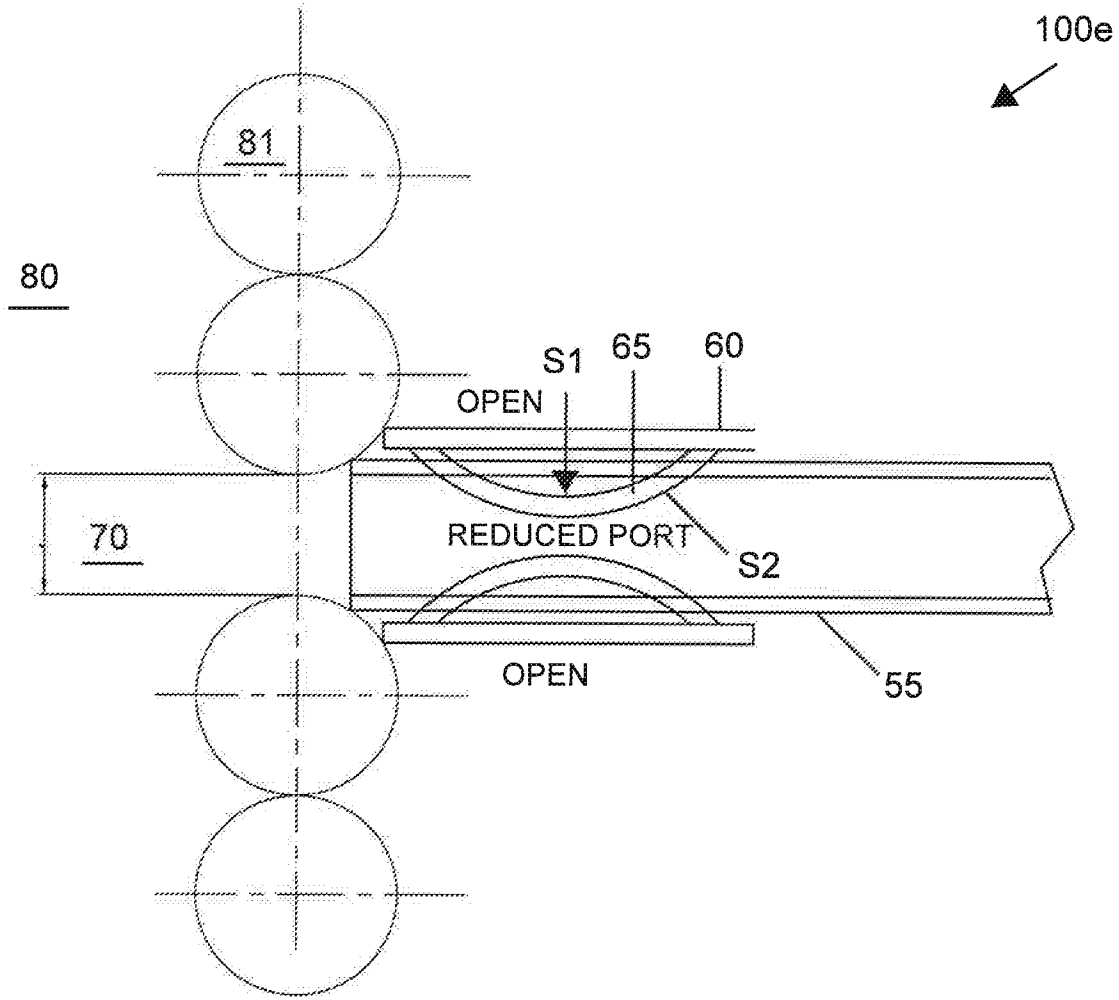
FIG. 5 is a top cross sectional view of a velocity type damper that includes two diaphragm plates that are positioned at opposing sides of the air port damper body that is connected to the air port to a furnace, in accordance with an embodiment of the present disclosure.

The present disclosure provides velocity type dampers for use for controlling airflow into a furnace through at least one of the air ports described above. The velocity type dampers 100*a*, 100*b*, 100*c*, 100*d*, 100*e* of the present disclosure are depicted in FIGS. 1-5. The term "velocity type" when describing the dampers of the present disclosure means that the damper can control the flow path of air to provide a jet of air through the connected air port 70 so that the velocity of air entering the furnace 80 through the air port 70 is substantially equal to the velocity of the air leaving the final air control surface of the damper 100*a*, 100*b*, 100*c*, 100*d*, 100*e*. The air control surface of the dampers described herein may be velocity plates 50 (as depicted in FIGS. 1-3), diaphragm plates 60 (as depicted in FIGS. 4-5), or combinations thereof.

In some embodiments, the black liquor sprayed into the firebox, swirls, burns and falls toward the bottom of the firebox in the form of combustion products comprising char material and smelt. The smelt and char material contact and flow down the outer walls of the firebox and, cooled by the inflowing air, form excrescent deposits around edges of the air ports, particularly along the top edges of the air ports where the excrescent material builds up and outward under influence of air rushing through the air port. Such buildup of char material can block air flow through a port by as much as fifty percent. In addition to controlling airflow into the furnace for general operations, the velocity type dampers 100*a*, 100*b*, 100*c*, 100*d*, 100*e* can also adjust airflow to account for the change of air flow capacity that results from the aforementioned buildup of char material.

Air flow adjustment through the dampers 100*a*, 100*b*, 100*c*, 100*d*, 100*e* can be achieved by manipulating the air control surfaces of the dampers 100*a*, 100*b*, 100*c*, 100*d*, 100*e* to increase or decrease the cross sectional area of the pathway of the airflow through the damper. In the embodiments depicted in FIGS. 1-2, the air control surface of the damper 100*a*, 100*b*, is a side velocity plate 50 that is in hinged engagement to the body, i.e., air port damper body 55. In some embodiments, as depicted in FIG. 3, the air control surface of the damper 100*c* is mounted on the top of the body, i.e., air port damper body 55. In this case, the velocity plate 50 is a top velocity plate. Both side velocity plates and top velocity plates can be referred to as a velocity plate having reference number 50. The term "hinged" denotes that one end of the velocity plate 50 is in engagement through a hinge 51 so that it may be rotated relative to a fixed point. A "hinge" is a mechanical bearing that connects two solid objects, typically allowing only a limited angle of rotation between them. For example, the hinge 51 allows for the velocity plate 50 to be rotated from an entirely open position (OPEN) providing the greatest cross sectional area for the air pathway through the damper to a substantially closed position (REDUCED PORT) that reduces the cross sectional area for the air pathway through the damper. In the entirely open position for the velocity plate 50, the length L1 of the velocity plate 50 is substantially parallel to the direction of air travel through the air port damper body 55. In the substantially closed position for the velocity plate 50, the velocity plate 50 is rotated from the open position about the hinge 51 towards the center of the air port damper body 55, which reduces the cross sectional area for the air pathway through the damper. By adjusting the cross sectional area of the pathway through the damper by rotating the velocity plate 50, the damper controls 100*a*, 100*b*, 100*c* air flow through the air port damper body 55 into the air port 70.

In the embodiments depicted in FIGS. 4-5, the air control surface of the damper 100*d*, 100*e* is a deformable air control diaphragm 65 that is in engagement to the body, i.e., air port damper body 55, of the diaphragm damper plate 60. The diaphragm plate 60 is connected to the wall of the air port damper body 55 on at least two opposing ends of a deformable sheet metal that provides the deformable air control diaphragm 65. The diaphragm damper plate 60 may include a deformable air control diaphragm 65 that includes a pressure applied surface S1 and an air control surface S2. The deformable air control surface 65 may be deformed by applying a force to the pressure applied surface S1. Applying a force, such as compressed air, pressurized hydraulic fluid, or a mechanical force, to the pressure applied surface S1 deforms the deformable air control diaphragm 65 so that the air control surface S1 is extended towards the center of the air port damper body 55, in which the greater the deformable air control diagram 65 is extended the lesser the cross sectional area for the air pathway through the damper. Removing the force, or applying an opposing force, such as a vacuum, to the pressure applied surface S1 can return the deformable air control diaphragm 65 back to an entirely open position for the damper, which provides the greatest cross sectional area through the air port damper body 55. By adjusting the cross sectional area of the pathway through the damper 100*d*, 100*e* by adjusting the deformable air control diaphragm 65, the damper controls air flow through the air port damper body 55 into the air port 70.

It has been determined that in prior damper designs that the decrease in the velocity of at the exit of the damper prior to the air being introduced to the furnace results from a change, i.e., increase, in volume of the air passage between the damper and the inlet to the furnace. More specifically, a high volume region is present from the end leaving the final air control surface of the damper. This means that although the adjustment of the damper can control air flow through the damper, control of the velocity of the jet of air through the damper is diminished by the presence of the high volume region, which limits the operational control of the damper.

Referring to FIGS. 1-5, the damper 100*a*, 100*b*, 100*c*, 100*d*, 100*e* provided by the present disclosure avoids this reduction in air velocity by reducing the change in volume between the damper exit and the inlet, e.g., air port opening 70, to the furnace 80. In some embodiments, the damper 100*a*, 100*b*, 100*c*, 100*d*, 100*e* designs described herein can provide for increased control of the airflow and increased control of the velocity of the air being introduced to the furnace 80 through the damper 100*a*, 100*b*, 100*c*, 100*d*, 100*e* by aligning the air control surfaces, e.g., damper blade edges, to the furnace wall at the inlet 70 (also referred to as air port opening 70). As described herein, the damper blade edges can be either the edge of the hinged velocity plates 50 that is closest to the inlet 70, i.e., opposite the edge of the velocity plate 50 connected to the hinge 51, and/or the edge of the deformable diagram plates 60 that are closest to the inlet 70. The term "aligning" as used to describe the positioning of the damper 100*a*, 100*b*, 100*c*, 100*d*, 100*e* relative to the air port opening 70 denotes that the damper blade edges for the control surfaces, such as the edge of the velocity plate 50 and/or diaphragm plate 60, are proximate to (and in some embodiments, in direct contact with) the furnace sidewall at the inlet 70. By being proximate to, it is meant that the damper 100*a*, 100*b*, 100*c*, 100*d*, 100*e* is positioned as close to the wall of the furnace 80 at the inlet 70 that will allow the damper 100*a*, 100*b*, 100*c*, 100*d*, 100*e* to function yet not extend into the furnace 80, e.g., extend past the inlet 70. By minimizing the presence of any high volume regions between the damper 100*a*, 100*b*, 100*c*, 100*d*, 100*e* and the inlet 70, the damper designs of the present disclosure provide that the air velocity leaving the damper 100*a*, 100*b*, 100*c*, 100*d*, 100*e* is substantially equal to the air velocity entering the furnace 80 through the inlet 70. Therefore, adjustment of the air control surfaces, such as the velocity plates 50 and the diaphragm plate 60, in the damper designs of the present disclosure to adjust air velocity through the damper 100*a*, 100*b*, 100*c*, 100*d*, 100*e* allow for accurate adjustment of the air velocity being introduced through to the furnace 80 through the inlet 70.

Referring to FIGS. 1-5, the air port damper body 55 of the dampers 100*a*, 100*b*, 100*c*, 100*d*, 100*e* is engaged to an air port opening 70 of the furnace 80. In some embodiments, the outer wall incorporates boiler tubes 81 to conduct water or steam for removing heat from the combustion process occurring within the furnace 80. The air port opening 70 is formed within the boiler outer wall. In some embodiments, the air port opening 70 defines a narrow rectangular slot which penetrates furnace wall for the admission of combustion air. As noted above, a typical boiler will have a multiplicity of air port openings 70, e.g., primary air port openings, secondary air port openings and ternary air port openings, strategically arranged around the perimeter of the boiler to admit supplemental air in desired quantities. In some embodiments, the damper designs 100*a*, 100*b*, 100*c*, 100*d*, 100*e* of the present disclosure are incorporated into primary air port openings, however the dampers 100*a*, 100*b*, 100*c*, 100*d*, 100*e* may be incorporated in connection with any of the air port openings, i.e., the primary air port openings, secondary air port openings, ternary air port openings and combinations thereof.

In some embodiments, the dampers 100*a*, 100*b*, 100*c*, 100*d*, 100*e* can be integrated into a wind box (not shown) that is also mounted to the exterior surface of the boiler outer wall. The wind box can be a sheet metal structure that is fastened to the boiler wall and can provide support for the components of the dampers 100*a*, 100*b*, 100*c*, 100*d*, 100*e* such as the air port damper body 55, and the air control surfaces, such as the velocity plates 50 and the diaphragm plate 60. The wind box may also have provisions for supporting a port rodder that is compatible with the dampers 100*a*, 100*b*, 100*c*, 100*d*, 100*e* that are described herein. The wind box encloses the air ports 70 and includes an opening to allow air to enter the wind box.

The damper 100*a* that is depicted in FIGS. 1 and 3 is one embodiment of a velocity type damper that includes a velocity plate 50 that is rotated about a hinged end 51 to provide the air control surface of the damper 100*a*. The damper 100*a* depicted in FIG. 1 includes a single velocity plate 50 engaged to one sidewall of the air port damper body 55. The damper 100*c* depicted in FIG. 3 includes a single velocity plate 50 engaged to an upper surface of the air port damper body 55. In some embodiments, the at least one velocity plate 50 is in hinged engagement to the air port damper body 55 so that the air controlling end surface of the at least one velocity plate is substantially aligned to a sidewall of the furnace 80 at the air port opening 70 when the at least one velocity plate 50 is in a fully opened position (OPEN). Rotating the at least one velocity plate 50 from the fully opened position (OPEN) reduces a cross sectional area of the air passageway through the air port damper body 55. In some embodiments, the velocity plate 50 may be rotated to a substantially closed (REDUCED PORT) about the hinge so that the maximum angle $\alpha$ at the interface of the air port damper body 55 and the velocity plate 50 is equal to 30° or less. In another embodiment, the velocity plate 50 may be rotated to a substantially closed (REDUCED PORT) about the hinge so that the maximum angle $\alpha$ at the interface of the air port damper body 55 and the velocity plate 50 is equal to 15° or less. It is noted that when the velocity plate 50 is in the substantially closed (REDUCED PORT) position, the cross sectional area through the air port damper body 55 may be reduced up to 70%. In another example, when the velocity plate 50 is in the substantially closed (REDUCED PORT) position, the cross sectional area through the air port damper body 55 may be reduced up to 50%. In an even further example, when the velocity plate 50 is in the substantially closed (REDUCED PORT) position, the cross sectional area through the air port damper body 55 may be equal to 25% or less. By controlling the cross sectional area through the air port damper body 55, the velocity plate 50 controls the air flow through the damper 100*a*.

The velocity plate 50 may be formed from a metal, such as steel, stainless steel or other alloys. The velocity plate 50 may be rigid and substantially planar in geometry. In other examples, the velocity plate 50 may include at least one curvature, which can aid in the control of air through the air port damper body 55. The edge of the velocity plate 50 opposite the edge of the velocity plate 50 that is directly connected to the hinge 51 is the end of the air control surface for the damper. Adjustment, e.g., the angle $\alpha$ produced by rotation, of the velocity plate 50 can be provided using hydraulic actuators, electrical actuators, pneumatic actuators and combinations thereof.

The velocity plate 50 may be positioned as close as possible to the wall of the furnace 80 near the inlet 70. In the embodiment depicted in FIG. 1, the velocity plate 50 is positioned so that the edge of the velocity plate that provides the end of the air control surface is in contact with the wall of the furnace when the velocity plate 50 is in the fully open position (OPEN). In some embodiments, the design of the damper 100*a* conforms to the curvatures of the furnace wall. For example, the sidewall of the furnace at the air port opening 70 can include a first convex curvature at an upper portion of the air port opening 70 and a second curvature at the lower portion of the air port opening 70. The end of the air port damper body 55 can contact the second curvature and can therefore be offset from the air controlling end surface of the velocity plate 50 when the velocity plate 50 is in a fully opened position (OPEN) and engages the first curvature of the sidewall at the air port opening 70, as depicted in FIG. 1.

Although FIGS. 1 and 3 illustrate a damper 100*a*, 100*c* having a single velocity plate 50, the present disclosure is not limited to only this example, as the dampers described herein may include any number of velocity plates 50. For example, FIG. 2 illustrates one embodiment of a velocity type damper 100*b* that includes two velocity plates 50 that are positioned at opposing sides of the air port damper body 55 that is connected to the air port 70 to the furnace 80. It is noted that each of the velocity plates 50 that are depicted in FIG. 2 are similar to the velocity plate 50 that has been described with reference to FIG. 1. Therefore, the description of the velocity plate 50 depicted in FIG. 1 can provide at least one example of the velocity plate 50 that is depicted in FIG. 2. It is noted that by increasing the number of velocity plates 50, the greater the obstruction of the cross sectional area of the air pathway through the air port damper body 55 when the multiple velocity plates 50 are open.

FIG. 4 depicts a velocity type damper 100*d* that includes a diaphragm plate 60 that can be deformed to provide the air control surface of the damper 100*d*. In one embodiment, the damper 100*d* includes an air port damper body 55 engaged to an air port opening 70 of a furnace 80. In one embodiment, the damper 100*d* further includes at least one diaphragm plate 60 engaged to the air port damper body 55 so that an end of the at least one diaphragm 60 is proximate to a wall of the furnace at the air port opening 70. The air control surface of the damper 100*d* is a deformable air control diaphragm 65 that is in engagement to the body, i.e., air port damper body 55, of the diaphragm damper plate 60. The deformable air control diaphragm 65 includes a pressure applied surface S1 and an air control surface S2.

Without a force applied to the pressure applied surface S1, the deformable air control surface 65 is positioned along a sidewall of the air port damper body 55 in an open position (OPEN). Applying a force, such as compressed air, pressurized hydraulic fluid, or a mechanical force, to the pressure applied surface S1 deforms the deformable air control surface 65 to extend from the sidewall of the air port damper body 55 towards the center of the air pathway through the damper 100*d*. The deformable air control surface 65 extended towards the center of the air pathway to a position (REDUCED PORT) that reduces the cross sectional area for the air pathway through the damper 100*d*. Removing the force, or applying an opposing force, such as a vacuum, to the pressure applied surface S1 can return the deformable air control diaphragm 65 back to an entirely open position (OPEN) for the damper, which provides the greatest cross sectional area through the air port damper body 55. It is noted that when the deformable air control diaphragm 65 is in the substantially closed (REDUCED PORT) position, the cross sectional area through the air port damper body 55 may be reduced up to 70%. In another example, when the deformable air control diaphragm 65 is in the substantially closed (REDUCED PORT) position, the cross sectional area through the air port damper body 55 may be reduced up to 50%. In an even further example, when the deformable air control diaphragm 65 is in the substantially closed (REDUCED PORT) position, the cross sectional area through the air port damper body 55 may be equal to 25% or less. By controlling the cross sectional area through the air port damper body 55, the deformable air control diaphragm 65 controls the air flow through the damper 100*d*.

The diaphragm plate 60 may be positioned as close as possible to the sidewall of the furnace 80 near the inlet 70.

The deformable air control diaphragm 65 of the diaphragm plate 60 may be formed from a deformable sheet metal, such as steel, stainless steel or an alloy. In other embodiments, the deformable air control diaphragm may be composed of a composite material. In one embodiment, the diaphragm plate 60 is connected to the sidewall of the air port damper body 55 on at least two opposing ends of the deformable sheet metal 65.

Although FIG. 4 illustrates a damper 100*d* having a single diaphragm plate 60, the present disclosure is not limited to only this example, as the dampers described herein may include any number of damper plates 60. For example, FIG. 5 illustrates one embodiment of a velocity type damper 100*e* that includes two diaphragm plates 60 that are positioned at opposing sides of the air port damper body 55 that is connected to the air port 70 to the furnace 80. It is noted that each of the diaphragm plates 60 that are depicted in FIG. 5 are similar to the diaphragm plate 60 that has been described with reference to FIG. 4. Therefore, the description of the diaphragm plate 60 depicted in FIG. 4 can provide at least one example of the diaphragm plates 60 that are depicted in FIG. 5. It is noted that by increasing the number of diaphragm plates 60, the greater the obstruction of the cross sectional area of the air pathway through the air port damper body 55 when the multiple diaphragm plates 60 are open.

The dampers 100*a*, 100*b*, 100*c*, 100*d*, 100*e* that are described herein may be used in a method for controlling airflow into a furnace 80. The method may include engaging a velocity type damper to an air port opening 70 of a furnace 80, as depicted in FIGS. 1-5. The velocity type dampers 100*a*, 100*b*, 100*c*, 100*d*, 100*e* can include at least one air controlling surface, e.g., velocity plate 50 and/or diaphragm plate 60, that is positioned proximate to a wall of the furnace at the air port opening 70 so that air velocity exiting the at least one air controlling surface is substantially equal to the air velocity entering the air port opening 70 to the furnace 80.

The method for controlling airflow into a furnace 80 further includes adjusting a cross sectional area through the velocity type damper 100*a*, 100*b*, 100*c*, 100*d*, 100*e* to control air velocity into the furnace 80 through the air port opening 70.

In some embodiments, the method employs a velocity type damper 100*a*, 100*b*, 100*c* that includes an air port damper body 55 is engaged to the air port opening 70 of the furnace 80, and the at least one velocity plate 50 in hinged engagement to the air port damper body 55 so that an end of the air controlling surface of the at least one velocity plate 50 is substantially aligned to the sidewall of the furnace 80 at the air port opening 70 when the at least one velocity plate 50 is in a fully opened position (OPEN), as depicted in FIGS. 1-3. Rotating the at least one velocity plate 50 from the fully opened position reduces a cross sectional area of the air passageway through the air port damper body 55. The change in the cross sectional area of the air passageway changes the velocity of the air passing through the damper 100*a*, 100*b*, 100*c*.

In some embodiments, the method employs a velocity type damper 100*d*, 100*e* that includes an air port damper body 55 and at least one diaphragm plate 60, as depicted in FIGS. 4 and 5. The air port damper body 55 is engaged to the air port opening 70 of the furnace 80. The at least one diaphragm plate 60 is engaged to the air port damper body 55 so that an end of the at least one diaphragm plate 60 is proximate to a sidewall of the furnace 80 at the air port opening 70. The diaphragm plate 60 includes a deformable air control diaphragm 65. Deforming the deformable air control diaphragm 65 of the diaphragm plate 60 reduces the cross sectional area of the air port damper body 55. The change in the cross sectional area of the air passageway changes the velocity of the air passing through the damper 100*d*, 100*e*.

It is further noted that the damper designs 100*a*, 100*b*, 100*c*, 100*d*, 100*e* may be integrated with a port rodder. Port rodders are provided on recovery boilers to clean the air ports or openings, keeping them free from combustion by-products and other deposits commonly referred to as char. By frequently cleaning the port openings, air flow is uniform from all ports into the boiler thus facilitating a high rate of heat transfer and optimum operation.

A rodder generally includes a tip or cutter mounted on the end of a ram which is in turn connected to an actuator which causes the ram to be extended or retracted, e.g., into the air port 70. One such actuator would be a pneumatic cylinder. Extension and retraction of the cylinder causes the cutter to move in and out of the port, e.g., air port 70. When extended into the air port 70, the cutter contacts and dislodges the char by cutting and/or pushing it through the port and into the boiler 80.

An exemplary damper comprises: an air port damper body engaged to an air port opening of a furnace; and at least one velocity plate in hinged engagement to the air port damper body so that the air controlling end surface of the at least one velocity plate is substantially aligned to a wall of the furnace at the air port opening when the at least one velocity plate is in a fully opened position.

An exemplary damper may have at least one velocity plate that includes a single velocity plate engaged to one sidewall of the air port damper body. An exemplary damper may have at least one velocity plate that includes a single velocity plate engaged to an upper wall of the air port damper body. In certain exemplary embodiments, the velocity plate is planar and substantially rigid.

An exemplary damper may have at least one velocity plate that includes two velocity plates, each one of the two velocity plates being engaged to wall portions of the air port damper body, wherein said wall portions are positioned at opposing sides of the air port damper body.

In an exemplary embodiment, the sidewall of the furnace at the air port opening includes a first convex curvature at an upper portion of the air port opening and a second curvature at the lower portion of the air port opening, wherein an end of the air port damper body is offset from the air controlling end surface of the at least one velocity plate when the at least one velocity plate is in a fully opened position to engage the first and second curvature of the sidewall at the air port opening.

An exemplary damper is configured to rotate the at least one velocity plate from the fully opened position to reduced port position to reduce a cross sectional area of the air passageway through the air port damper body.

Another exemplary damper comprises: an air port damper body engaged to an air port opening of a furnace; and at least one diaphragm plate engaged to the air port damper body so that an end of the at least one diaphragm is proximate to a wall of the furnace at the air port opening, wherein deforming the at least one diaphragm plate reduces the cross sectional area of the air port damper body.

In an exemplary diaphragm embodiment the at least one diaphragm plate is comprised of deformable metal or composite having a pressure application surface and an air control surface, the pressure application surface receiving a deformation force for deforming the deformable metal or composite to provide that the at least one diaphragm plate reduces the cross sectional area of the air port damper body, wherein the air control surface is opposite the pressure application surface and is contacted by air passed through the air port damper body.

In an exemplary diaphragm embodiment, the diaphragm plate is connected to the wall of the air port damper body on at least two opposing ends of the deformable metal or composite.

An exemplary method for controlling airflow into a furnace comprises: engaging a velocity type damper to an air port opening of a furnace, in which the velocity type damper includes at least one air controlling surface that is positioned proximate to a wall of the furnace at the air port opening so that air velocity exiting the at least one air controlling surface is substantially equal to the air velocity entering the air port opening to the furnace; and adjusting a cross sectional area through the velocity type damper to control air velocity into the furnace through the air port opening.

In an exemplary method, the velocity type damper comprises an air port damper body and at least one velocity plate, wherein the an air port damper body is engaged to the air port opening of the furnace, and the at least one velocity plate is in hinged engagement to the air port damper body so that an end of the air controlling surface of the at least one velocity plate is substantially aligned to the sidewall of the furnace at the air port opening when the at least one velocity plate is in a fully opened position.

In an exemplary method, the at least one velocity plate includes a single velocity plate engaged to one wall of the air port damper body.

In an exemplary method, the at least one velocity plate includes two velocity plates, each one of the two velocity plates is engaged to sidewall portions of the air port damper body, wherein said sidewall portions are positioned at opposing sides of the air port damper body.

In an exemplary method, rotating the at least one velocity plate from the fully opened position reduces a cross sectional area of the air passageway through the air port damper body.

In an exemplary method, the velocity type damper comprises an air port damper body and at least one diaphragm plate, the air port damper body engaged to the air port opening of the furnace; the at least one diaphragm plate engaged to the air port damper body so that an end of the at least one diaphragm is proximate to a wall of the furnace at the air port opening, wherein deforming the at least one diaphragm plate reduces the cross sectional area of the air port damper body.

In an exemplary method, the at least one diaphragm plate is comprised of deformable sheet metal having a pressure application surface and an air control surface, the pressure application surface receiving a deformation force for deforming the deformable sheet metal to provide that the at least one diaphragm plate reduces the cross sectional area of the air port damper body, wherein the air control surface is opposite the pressure application surface and is contacted by air passed through the air port damper body.

In an exemplary method, the diaphragm plate is connected to the wall of the air port damper body on at least two opposing ends of the deformable sheet metal.

It will also be understood that when an element is referred to as being "on" or "over" another element, it can be directly on the other element or intervening elements can also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This can be extended, as readily apparent by one of ordinary skill in this and related arts, for as many items listed.

The terminology used herein is for the purpose of describing particular embodiments only and is not intended to be limiting of example embodiments. As used herein, the singular forms "a," "an" and "the" are intended to include the plural forms as well, unless the context dearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, such as "beneath," "below," "lower," "above," "upper," and the like, can be used herein for ease of description to describe one element's or feature's relationship to another element(s) or feature(s) as illustrated in the FIGS. It will be understood that the spatially relative terms are intended to encompass different orientations of the device in use or operation in addition to the orientation depicted in the FIGS. For example, if the device in the FIGS. is turned over, elements described as "below" or "beneath" other elements or features would then be oriented "above" the other elements or features. Thus, the term "below" can encompass both an orientation of above and below. The device can be otherwise oriented (rotated 90 degrees or at other orientations), and the spatially relative descriptors used herein can be interpreted accordingly. In addition, it will also be understood that when a layer is referred to as being "between" two layers, it can be the only layer between the two layers, or one or more intervening layers can also be present.

It will be understood that, although the terms first, second, etc. can be used herein to describe various elements, these elements should not be limited by these terms. These terms are only used to distinguish one element from another element. Thus, a first element discussed below could be termed a second element without departing from the scope of the present concept.

Having described preferred embodiments of a method, structures and systems for velocity dampers for a recovery boiler, it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A damper comprising:

an air port damper body engaged to an air port opening of a furnace; and at least one diaphragm plate engaged to the air port damper body so that an end of the at least one diaphragm plate is proximate to a wall of the furnace at the air port opening, wherein deforming the at least one diaphragm plate reduces a cross sectional area of the air port damper body.

2. The damper of claim 1, wherein the at least one diaphragm plate includes a single diaphragm plate engaged to one wall of the air port damper body.

3. The damper of claim 1, wherein the at least one diaphragm plate includes two diaphragm plates, each one of the two diaphragm plates is engaged to wall portions of the air port damper body, wherein said wall portions are positioned at opposing sides of the air port damper body.

4. The damper of claim 1, wherein the at least one diaphragm plate is comprised of deformable metal or composite having a pressure application surface and an air control surface, the pressure application surface receiving a deformation force for deforming the deformable metal or composite to provide that the at least one diaphragm plate reduces the cross sectional area of the air port damper body, wherein the air control surface is opposite the pressure application surface and is contacted by air passed through the air port damper body.

5. The damper of claim 4, wherein the diaphragm plate is connected to the wall of the air port damper body on at least two opposing ends of the deformable metal or composite.

6. A method for controlling airflow into a furnace comprising:

engaging a velocity type damper to an air port opening of a furnace, in which the velocity type damper includes at least one air controlling surface that is positioned proximate to a wall of the furnace at the air port opening so that air velocity exiting the at least one air controlling surface is substantially equal to the air velocity entering the air port opening to the furnace, wherein the velocity type damper comprises an air port damper body and at least one diaphragm plate, the air port damper body engaged to the air port opening of the furnace; the at least one diaphragm plate engaged to the air port damper body so that an end of the at least one diaphragm plate is proximate to a wall of the furnace at the air port opening, wherein deforming the at least one diaphragm plate reduces a cross sectional area of the air port damper body; and adjusting a cross sectional area through the velocity type damper to control air velocity into the furnace through the air port opening.

7. The method of claim 6, wherein the at least one diaphragm plate is comprised of deformable sheet metal having a pressure application surface and an air control surface, the pressure application surface receiving a deformation force for deforming the deformable sheet metal to provide that the at least one diaphragm plate reduces the cross sectional area of the air port damper body, wherein the air control surface is opposite the pressure application surface and is contacted by air passed through the air port damper body.

8. The method of claim 7, wherein the diaphragm plate is connected to the wall of the air port damper body on at least two opposing ends of the deformable sheet metal.

* * * * *